US009388808B2

(12) United States Patent
Iitsuka et al.

(10) Patent No.: US 9,388,808 B2
(45) Date of Patent: Jul. 12, 2016

(54) SCROLL COMPRESSION DEVICE

(75) Inventors: Satoshi Iitsuka, Gunma-ken (JP); Tsutomu Kon, Gunma-ken (JP); Kazuyoshi Sugimoto, Gunma-ken (JP); Yoshihiko Nagase, Gunma-ken (JP)

(73) Assignee: PANASONIC INTELLECTUAL PROPERTY MANAGEMENT CO., LTD., Osaka-shi (JP)

( * ) Notice: Subject to any disclaimer, the term of this patent is extended or adjusted under 35 U.S.C. 154(b) by 229 days.

(21) Appl. No.: 14/007,244

(22) PCT Filed: Dec. 20, 2011

(86) PCT No.: PCT/JP2011/079463

§ 371 (c)(1),
(2), (4) Date: Nov. 6, 2013

(87) PCT Pub. No.: WO2012/127749

PCT Pub. Date: Sep. 27, 2012

(65) Prior Publication Data

US 2014/0044574 A1 Feb. 13, 2014

(30) Foreign Application Priority Data

Mar. 24, 2011 (JP) ..... 2011-065607

(51) Int. Cl.
*F04C 18/02* (2006.01)
*F04C 23/00* (2006.01)

(52) U.S. Cl.
CPC ..... *F04C 18/0207* (2013.01); *F04C 18/0215* (2013.01); *F04C 23/008* (2013.01); *F04C 2240/403* (2013.01); *F04C 2240/807* (2013.01); *F05C 2251/125* (2013.01)

(58) Field of Classification Search
CPC ..... F04C 18/0207; F04C 18/0215; F04C 2240/403; F04C 2240/807; F04C 23/008; F05C 2251/125
See application file for complete search history.

(56) References Cited

U.S. PATENT DOCUMENTS 4,496,293 A 1/1985 Nakamura et al.
2002/0140309 A1* 10/2002 Yanashima ..... F04B 35/04 310/162

(Continued)

FOREIGN PATENT DOCUMENTS

CN 1447491 A 10/2003
CN 1480695 A 3/2004

(Continued)

OTHER PUBLICATIONS

International Search Report issued in PCT/JP2011/079464, mailing date of Mar. 19, 2012, w/English translation (4 pages).

(Continued)

*Primary Examiner* — Peter J Bertheaud
*Assistant Examiner* — Dominick L Plakkoottam
(74) *Attorney, Agent, or Firm* — Westerman, Hattori, Daniels & Adrian, LLP

(57) ABSTRACT

A scroll compression device that is adaptable to a larger elimination capacity by using a balancer of magnetic material is provided. A scroll compression mechanism 11 for compressing refrigerant and a driving motor 13 that is connected to the scroll compression mechanism 11 through a driving shaft 15 and drives the scroll compression mechanism 11 are accommodated in a casing 3, the scroll compression mechanism 11 is supported in the casing by a main frame 21, a rotor 39 of the driving motor 13 is connected to the driving shaft 15, the driving shaft 15 is supported in the casing by a bearing plate 8, an upper balancer 63 of magnetic material is secured onto the shaft above the stator 37 of the driving shaft 15, a lower balancer 77 of non-magnetic material is secured to the lower end of the rotor 39, and an auxiliary balancer 64 of non-magnetic material is secured in the gap between the upper end of the rotor 39 and the upper balancer 63.

7 Claims, 3 Drawing Sheets

(56) References Cited

U.S. PATENT DOCUMENTS

| | | | | |
|---|---|---|---|---|
| 2003/0012672 | A1* | 1/2003 | Sowa | F04C 18/0207 418/151 |
| 2004/0040323 | A1 | 3/2004 | Yokozeki et al. | |
| 2004/0197213 | A1* | 10/2004 | Takemoto | F04B 35/04 417/410.1 |
| 2005/0086960 | A1 | 4/2005 | Yokozeki et al. | |
| 2005/0210663 | A1 | 9/2005 | Ishida et al. | |
| 2005/0220652 | A1 | 10/2005 | Yamaji et al. | |
| 2007/0070560 | A1* | 3/2007 | Hikawa | G01K 7/00 361/29 |
| 2008/0298986 | A1 | 12/2008 | Ishida et al. | |
| 2009/0293534 | A1* | 12/2009 | Tanaka | F04C 18/3564 62/470 |
| 2012/0007455 | A1 | 1/2012 | Tanaka | |

FOREIGN PATENT DOCUMENTS

| | | | |
|---|---|---|---|
| CN | 1550669 | A | 12/2004 |
| CN | 1638241 | A | 7/2005 |
| CN | 1698249 | A | 11/2005 |
| CN | 101145716 | A | 3/2008 |
| EP | 2416013 | A1 | 2/2012 |
| JP | 55-46081 | A | 3/1980 |
| JP | 57-212389 | A | 12/1982 |
| JP | 58-165907 | A | 10/1983 |
| JP | 59-29785 | A | 2/1984 |
| JP | 60-075795 | A | 4/1985 |
| JP | 60-206998 | A | 10/1985 |
| JP | 61-167354 | A | 7/1986 |
| JP | 05-312157 | A | 11/1993 |
| JP | 11-132164 | A | 5/1999 |
| JP | 11-275824 | A | 10/1999 |
| JP | 11-341752 | A | 12/1999 |
| JP | 2000-161268 | A | 6/2000 |
| JP | 2001-41184 | A | 2/2001 |
| JP | 2002-199670 | A | 7/2002 |
| JP | 2003-35289 | A | 2/2003 |
| JP | 2003-230260 | A | 8/2003 |
| JP | 2004-011473 | A | 1/2004 |
| JP | 2004-60532 | A | 2/2004 |
| JP | 2004-251173 | A | 9/2004 |
| JP | 2004-293492 | A | 10/2004 |
| JP | 2005-188519 | A | 7/2005 |
| JP | 2006-132419 | A | 5/2006 |
| JP | 2006-212746 | A | 8/2006 |
| JP | 2007-187049 | A | 7/2007 |
| JP | 2007-228684 | A | 9/2007 |
| JP | 2008-190444 | A | 8/2008 |
| JP | 2009-097358 | A | 5/2009 |
| JP | 2009-097417 | A | 5/2009 |
| JP | 2009097358 | A * | 5/2009 |
| JP | 2009-162078 | A | 7/2009 |
| JP | 2009-243363 | A | 10/2009 |
| JP | 2009-293589 | A | 12/2009 |
| JP | 2011-047343 | A | 3/2011 |

OTHER PUBLICATIONS

International Search Report issued in PCT/JP2011/079465, mailing date of Mar. 19, 2012, w/English translation (4 pages).
International Search Report issued in PCT/JP2011/079466, mailing date of Mar. 19, 2012, w/English translation (2 pages).
International Search Report issued in PCT/JP2011/079467, mailing date of Mar. 19, 2012, w/English translation (4 pages).
International Search Report issued in PCT/JP2011/079468, mailing date of Mar. 19, 2012, w/English translation (4 pages).
International Search Report issued in PCT/JP2011/079469, mailing date of Mar. 19, 2012, w/English translation (4 pages).
Office Action dated Apr. 27, 2015 issued in counterpart Chinese application No. 201180069296.7, with English translation. (20 pages).
Office Action dated Apr. 28, 2015 issued in counterpart Chinese application No. 2011800694407, with English translation. (18 pages).
Office Action dated May 6, 2015 issued in counterpart Chinese application No. 201180069287.8 , with English translation. (27 pages).
Office Action dated May 26, 2015 issued in counterpart Chinese application No. 201180069545.2 , with English translation. (14 pages).
Office Action dated May 28, 2015 issued in counterpart Chinese application No. 201180069472.7, with English translation. (18 pages).
International Search Report dated Mar. 19, 2012, issued in corresponding application No. PCT/JP2011/079463.
Written Opinion dated Mar. 19, 2012, issued in corresponding application No. PCT/JP2011/079463.
Notification of Transmittal of Translation of the International Preliminary Report on Patentabililty (Form PCT/IB/338) of International Application No. PCT/JP2011/079463 mailed Oct. 3, 2013 with Forms PCT/IB/373 and PCT/ISA/237.
Office Action dated Oct. 7, 2014, issued in Japanese Patent Application No. 2011-067051, with English Translation (7 pages).
Office Action dated Oct. 7, 2014, issued in Japanese Patent Application No. 2011-071495, with English Translation (6 pages).
Office Action dated Oct. 7, 2014, issued in Japanese Patent Application No. 2011-071324, with English Translation (7 pages).
Notification to Grant the Patent Right for Invention with Search Report dated Jan. 22, 2016, issued in counterpart Chinese Patent Application No. 201180069472.7, with English translation. (4 pages).

* cited by examiner

SCROLL COMPRESSION DEVICE

TECHNICAL FIELD

The present invention relates to a scroll compression device that perform compression through the engagement between a fixed scroll and a swing scroll.

BACKGROUND ART

There has been hitherto known a scroll compression device that has a compression mechanism comprising a fixed scroll and a swing scroll having mutually engageable spiral laps in a hermetically sealed casing and in which the compression mechanism is driven by a driving motor so that the swing scroll makes a circular motion with respect to the fixed scroll without rotating on its own axis, thereby performing compression (see Patent Document 1, for example). In this scroll compression device, the swing scroll is inserted and fitted in an eccentric shaft portion which is provided eccentrically from the shaft center of the driving shaft of the driving motor. Therefore, in the scroll compression device, an upper balancer which opposes the centrifugal force caused by the circular motion of the swing scroll is provided at the upper side of the driving motor of the driving shaft, and a lower balancer which directs in the opposite direction to the upper balancer is provided at the lower side of the driving motor of the driving shaft.

PRIOR ART DOCUMENT

Patent Document

Patent Document 1: JP-A-H05-312157

SUMMARY OF THE INVENTION

Problem to be Solved by the Invention

However, when a balancer formed of magnetic material such as inexpensive iron or the like is used, in order to prevent leakage magnetic flux from the rotor of the driving shaft, it is necessary that a rotor and a balancer are assembled away from each other at a predetermined distance or more so as to be insulated from each other. In order to provide a gap between the rotor and the balancer, the balancer cannot be designed to be large. Therefore, when a balancer formed of magnetic material is used, there is a problem that an elimination capacity cannot be increased.

The present invention has an object to solve the problem of the above prior art and has an object to provide a scroll compression device that is adaptable to a larger elimination capacity.

Means of Solving the Problem

In order to attain the above object, a scroll compression device according to the present invention is characterized in that a scroll compression mechanism for compressing refrigerant and a driving motor that is connected to the scroll compression mechanism through a driving shaft and drives the scroll compression mechanism are accommodated in a casing, the scroll compression mechanism is supported in the casing by a main frame, a stator of the driving motor is directly or indirectly supported in the casing, the driving shaft is connected to a rotor of the driving motor and the driving shaft is supported in the casing by a bearing plate, an upper balancer formed of magnetic material is secured onto the shaft above the stator of the driving shaft, a lower balancer formed of non-magnetic material is secured to a lower end of the rotor, and an auxiliary balancer formed of non-magnetic material is secured in a gap between an upper end of the rotor and the upper balancer.

In this invention, in order to prevent leakage magnetic flux of the rotor, the auxiliary balancer of non-magnetic material is secured to the gap between the upper balancer of magnetic material and the rotor. Therefore, even when the elimination capacity is increased, the driving shaft can rotate with keeping the balance with the swing scroll which makes an eccentric circular motion, and the scroll compression device adaptable to a larger elimination capacity can be provided by using the balancer formed of magnetic material.

In this construction, the lower balancer and the auxiliary balancer may be swaged to the rotor by using a rivet. Furthermore, the auxiliary balancer may be secured only just below the upper balancer.

Effect of the Invention

According to the present invention, the upper balancer of magnetic material is secured onto the shaft above the stator of the driving shaft, the lower balancer of non-magnetic material is secured to the lower end of the rotor, and the auxiliary balancer of non-magnetic material is secured to the gap between the upper end of the rotor and the upper balancer. Therefore, the auxiliary balancer of non-magnetic material can be secured to the gap between the upper balancer of magnetic material and the rotor to prevent leakage magnetic flux of the rotor. Even when the elimination capacity is increased, the driving shaft can rotate with keeping the balance with the swing scroll which moves eccentrically circularly, and the scroll compression device adaptable to a larger elimination capacity can be provided by using the balancer of magnetic material.

BRIEF DESCRIPTION OF THE INVENTION

MODE FOR CARRYING OUT THE INVENTION

An embodiment according to the present invention will be described with reference to the drawings.

Figure 1:
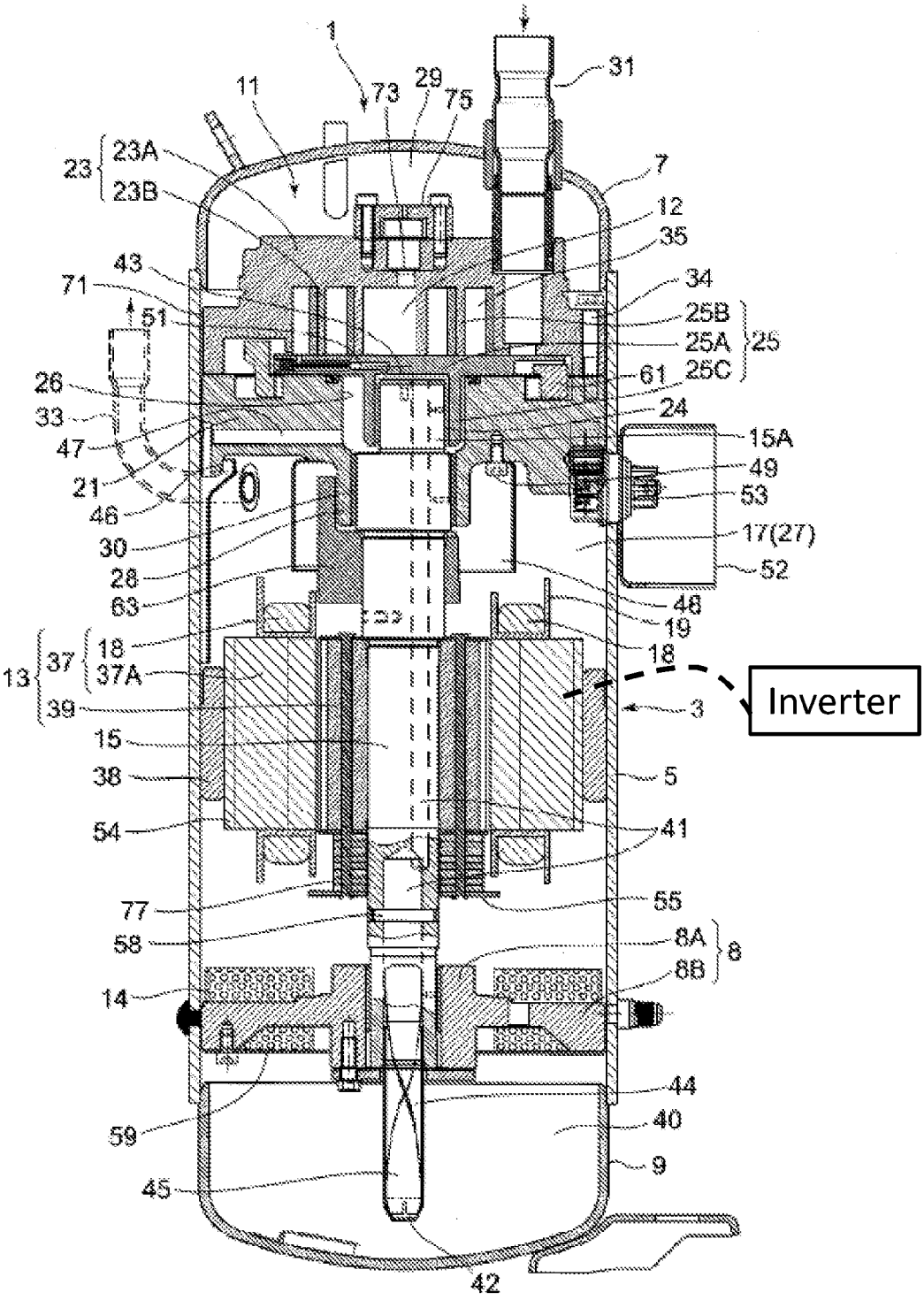
FIG. 1 is a cross-sectional view showing a scroll compression device according to an embodiment of the present invention.

In FIG. 1, reference numeral 1 represents a scroll compression device whose internal pressure is high. The compression device 1 is connected to a refrigerant circuit (not shown) in which refrigerant is circulated to perform a refrigeration cycle operation, and compresses the refrigerant. The compressor 1 has a hermetically-sealed doom type casing 3 having a vertically elongated cylindrical shape.

The casing 3 is configured as a pressure container comprising a casing main body 5 as a cylindrical barrel portion having an axial line extending in the up-and-down direction, a cup-shaped upper cap 7 which is air-tightly welded and integrally joined to the upper end portion of the casing main body 5 and has a convex surface protruding upwards, and a cup-shaped lower cap 9 which is air-tightly welded and integrally joined to the lower end portion of the casing main body 5 and has a convex surface protruding downwards. The inside of the casing 3 is hollow. A terminal cover 52 is provided to the outer peripheral surface of the casing 3, and a power supply terminal 53 for supplying power to a stator 37 described later is provided in the terminal cover 52.

In the casing 3 are accommodated a scroll compression mechanism 11 for compressing refrigerant and a driving motor 13 disposed below the scroll compression mechanism 11. The scroll compression mechanism 11 and the driving motor 13 are connected to each other through a driving shaft 15 which is disposed so as to extend in the up-and-down direction in the casing 3. A gap space 17 is formed between the scroll compression mechanism 11 and the driving motor 13.

A main frame 21 is accommodated at the inner upper portion of the casing 3, and a radial bearing portion 28 and a boss mount portion 26 are formed at the center of the main frame 21. The radial bearing portion 28 pivotally supports the tip (upper end) side of the driving shaft 15, and is configured to project downwards from the center of one surface (lower side surface) of the main frame 21. The boss mount portion 26 is used to accommodate therein a boss 25C of a swing scroll 25 described later, and formed by concaving the center of the other surface (upper side surface) of the main frame 21 downwards. An eccentric shaft portion 15A is formed at the tip (upper end) of the driving shaft 15. The eccentric shaft portion 15A is provided so that the center thereof is eccentric from the shaft center of the driving shaft 15, and inserted through a slewing bearing in the boss 25C so as to be turnably driven.

The scroll compression mechanism 11 comprises a fixed scroll 23 and a swing scroll 25. The fixed scroll 23 is disposed in close contact with the upper surface of the main frame 21. The main frame 21 is secured to the inner surface of the casing main body 5, and the fixed scroll 23 is fastened and fixed to the main frame 21 by a screw 34. The swing scroll 25 is engaged with the fixed scroll 23, and disposed in a swing space 12 formed between the fixed scroll 23 and the main frame 21. The inside of the casing 3 is partitioned into a high-pressure space 27 below the main frame 21 and a discharge space 29 above the main frame 21. The respective spaces 27 and 29 intercommunicate with each other through vertical grooves 71 which are formed on the outer peripheries of the main frame 21 and the fixed scroll 23 so as to extend vertically.

An intake pipe 31 for introducing the refrigerant in the refrigerant circuit to the scroll compression mechanism 11 air-tightly and fixedly penetrates through the upper cap 7 of the casing 3, and a discharge pipe 33 for discharging the refrigerant in the casing 3 to the outside of the casing 3 air-tightly and fixedly penetrates through the casing main body 5. The intake pipe 31 extends in the up-and-down direction in the discharge space 29, and the inner end portion thereof penetrates through the fixed scroll 23 of the scroll compression mechanism 11 and intercommunicates with the compression chamber 35, whereby the refrigerant is sucked into the compression chamber 35 through the intake pipe 31.

The driving motor (DC driving motor) 13 is a DC (Direct Current) motor which is actuated upon an input from a DC power source, and has an annular stator 37 and a rotor 39 which is freely rotatably provided in the stator 37. The driving motor 13 is operated while the rotation torque thereof is controlled by a PWM (Pulse Width Modulation) inverter which receives a constant input voltage and controls the duty ratio of pulse waves, that is, an output period of the pulse waves and the pulse width of the output pulse waves.

The swing scroll 25 of the scroll compression mechanism 11 is operationally connected to the rotor 39 through the driving shaft 15. The stator 37 comprises a stator core 37A and a stator coil 18. The stator core 37A is formed by laminating thin iron plates and has plural grooves (not shown) therein. The stator coil 18 is formed by winding stator windings of plural phases, and provided to be fitted in the grooves formed in the stator core 37A at the upper and lower sides of the stator core 37A. The stator coil 18 is accommodated in an insulator 19. The stator 18 is connected to the power supply terminal 53 through a conductive wire (not shown).

The rotor 39 is magnetized by ferrite magnet or neodymium magnet. As a method of magnetizing the rotor 39 is known a winding magnetizing method of inserting the rotor 39 in the stator 37 and then passing current through stator windings forming the stator coil 18 of the stator 37 to magnetize the rotor 39, or an externally magnetizing method of magnetizing the rotor 39 by using an external magnetizing device and then inserting the rotor 39 in the stator 37. A holder (pin holder) 58 described later in detail is pressed in the driving shaft 15, and used to position the rotor 39 when the winding magnetization of the rotor 39 is performed.

The stator 37 is supported on the inner wall of the casing 3 by an annular spacer ring 38. The spacer ring 38 is fixed to the inner wall surface of the casing 3 by shrinkage fitting, and the stator 37 is fixed to the inner wall surface of the spacer ring 38 by shrinkage fitting. The upper end surface of the spacer ring 38 is provided at a lower position than the upper end surface of the stator 37.

Figure 2:
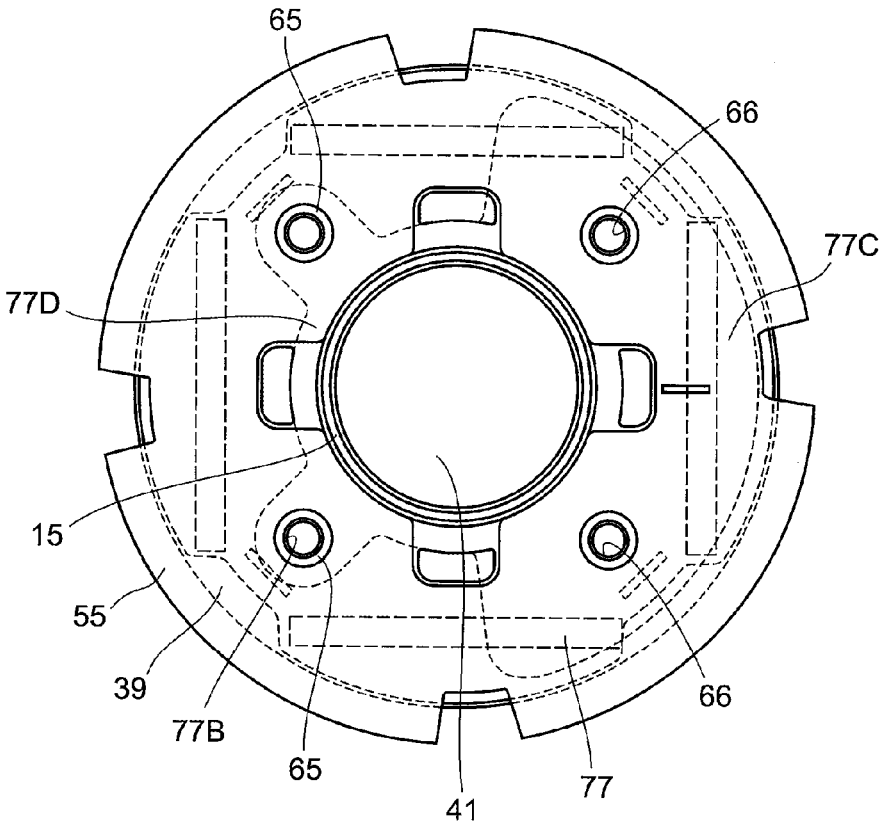
FIG. 2 is a diagram of an aspect of a lower balancer.

A bearing plate 8 in which the lower end portion of the driving shaft 15 is rotatably fitted and supported is provided below the driving motor 13. As shown in FIG. 2, the bearing plate 8 has a boss portion 8A into which the cylindrical driving shaft 15 is fitted, and arm portions 8B which are provided at substantially equal intervals on the periphery of the boss portion 8A so as to extend in the four directions and fixed to the casing main body 5. That is, the driving shaft 15 is supported in the casing 3 by the bearing plate 8. The bearing plate 8 has opening portions 8E which are formed among the respective arm portions 8B and through which upper and lower spaces above and below the bearing plate 8 intercommunicate with each other.

As shown in FIG. 1, the lower space (oil pool) 40 below the bearing plate 8 is kept at high pressure, and oil is pooled at the inner bottom portion of the lower cap 9 corresponding to the lower end portion of the lower space 40. An annular plate 59 is provided between the bearing plate 8 and the oil pool 40 so as to be fixed to the bearing plate 8. Furthermore, a baffle plate 14 is provided above the annular plate 59 so as to be supported by the annular plate 59. The baffle plate 14 is formed of thin plate type punching metal having many fine pores, for example.

A oil supply path 41 as a part of high-pressure oil supplying means is formed in the driving shaft 15, and the oil supply path 41 extends vertically in the driving shaft 15 and intercommunicates with an oil chamber 43 at the back side of the swing scroll 25. The oil supply path 41 is connected to an oil pickup 45 provided to the lower end of the driving shaft 15. A lateral hole 57 is provided at the back side of the oil pickup 45 so as to extend in the radial direction of the driving shaft 15 and penetrates through the oil supply path 41. The holder 58 described above is pressed into the lateral hole 57. The oil pickup 45 is pressed into the driving shaft 15 after the rotor 39 is magnetized.

The oil pickup 45 has a suction port 42 provided to the lower end thereof, and a paddle 44 formed above the suction port 42. The lower end of the oil pickup 45 is immersed in lubrication oil pooled in the oil pool 40, and the suction port 42 of the oil supply path 41 is opened in the lubrication oil. When the driving shaft 15 rotates, the lubrication oil pooled in the oil pool 40 enters the oil supply path 41 from the suction port 42 of the oil pickup 45, and is pumped up along the paddle 44 of the oil supply path 41. The thus-pumped lubrication oil is passed through the oil supply path 41, and supplied to the respective sliding portions of the scroll compression mechanism 11 such as the radial bearing portion 28, the slewing bearing 24, etc. Furthermore, the lubrication oil is supplied through the oil supply path 41 to the oil chamber 43 at the back side of the swing scroll 25, and supplied from the oil chamber 43 through an intercommunication path 51 provided to the swing scroll 25 to the compression chamber 35.

The main frame 21 penetrates radially from the boss mount portion 26 through the main frame 21 to form a return oil path 47 opened to the vertical groove 71. Excessive lubrication oil out of the lubrication oil supplied through the oil supply path 41 to the respective sliding portions of the scroll compression mechanism 11 and the compression chamber 35 is passed through the return oil path 47 and returned to the oil pool 40. An oil collector 46 is provided below the return oil path 47, and the oil collector 46 extends to the neighborhood of the upper end of the spacer ring 38. Plural notches 54 are formed on the outer peripheral surface of the stator 37 so as to extend between the upper and lower sides of the stator 37. The lubrication oil returned from the oil supply path 41 through the return oil path 47 and the oil collector 46 is passed through the gap between the notches 54 and the gap between the respective arm portions 8B and returned to the oil pool 40. In the cross-sectional view of FIG. 1, the discharge pipe 33 is represented by broken lines for the purpose of simplification of description, but the discharge pipe 33 is disposed to be displaced in phase from the oil collector 46.

The fixed scroll 23 comprises an end plate 23A and a spiral (involute type) lap 23B formed on the lower surface of the end plate 23A. The swing scroll 25 comprises an end plate 25A and a spiral (involute type) lap 23B formed on the upper surface of the end plate 25A. The lap 23B of the fixed scroll 23 and the lap 25B of the swing scroll 25 are engaged with each other, whereby plural compression chambers 35 are formed between the fixed scroll 23 and the swing scroll 25 by both the laps 23B, 25B.

The swing scroll 25 is supported by the fixed scroll 23 through an Oldham's ring 61, and a cylindrical boss 25C having a bottom is provided to the center portion of the lower surface of the end plate 25A so as to protrude from the center portion. Furthermore, the eccentric shaft portion 15A is provided to the upper end of the driving shaft 15, and the eccentric shaft portion 15A is rotatably fitted in the swing scroll 25.

Furthermore, an upper balancer 63 formed of inexpensive magnetic material such as iron or the like is secured to the driving shaft 15 so as to be located on the shaft above the stator 37 and below the main frame 21. A lower balancer 77 formed of non-magnetic material such as brass or the like is secured to the lower end of the rotor 39. A gap of 6mm or more is provided between the upper end of the rotor 39 and the upper balancer 63 formed of magnetic material to prevent leakage magnetic flux of the rotor 39. An auxiliary balancer 64 formed of non-magnetic material is secured in the gap. As described in detail later, the driving shaft 15 keeps dynamic balance with the swing scroll 25, the eccentric shaft portion 15A, etc. by the upper balancer 63, the lower balancer 77 and the auxiliary balancer 64.

A cup 48 is fixed to the lower side of the main frame 21 by a bolt 49 so as to surround the periphery of the counterweight portion 63. The cup 48 prevents the lubrication oil leaking from the clearance between the main frame 21 and the driving shaft 15 from scattering to the discharge pipe side due to rotation of the counterweight portion 63.

A discharge hole 73 is provided to the center portion of the fixed scroll 23, and gas refrigerant discharging from the discharge hole 73 passes through a discharge valve 75, discharges to the discharge space 29, and then flows out through the vertical grooves 71 provided on the outer peripheries of the main frame 21 and the fixed scroll 23 to the high-pressure space 27 below the main frame 21. This high-pressure refrigerant is discharged to the outside of the casing 3 through the discharge pipe 33 provided to the casing main body 5.

The driving operation of the scroll compression device 1 will be described.

When the driving motor 13 is actuated, the rotor 39 rotates with respect to the stator 37, whereby the driving shaft 15 rotates. When the driving shaft 15 rotates, the swing scroll 25 of the scroll compression mechanism 11 makes only an orbital motion around the fixed scroll 23 without making autorotation. Accordingly, low-pressure refrigerant is passed through the suction pipe 31 and sucked from the peripheral edge side of the compression chamber 35 into the compression chamber 35. This refrigerant is compressed due to the volumetric change of the compression chamber 35, and this compressed refrigerant becomes high-pressure and is discharged from the compression chamber 35 through the discharge valve 75 to the discharge space 29, and then flows out through the vertical grooves 71 provided on the respective outer peripheries of the main frame 21 and the fixed scroll 23 to the high-pressure space 27 below the main frame 21. This high-pressure refrigerant is discharged to the outside of the casing 3 through the discharge pipe 33 provided to the casing main body 5. The refrigerant discharged to the outside of the casing 3 is circulated in the refrigerant circuit (not shown), sucked through the suction pipe 31 into the compressor 1 and compressed again. The circulation of the refrigerant described above is repeated.

The flow of the lubrication oil will be described. The lubrication oil pooled at the inner bottom portion of the lower cap 9 in the casing 3 is sucked up by the oil pickup 45, passed through the oil supply path 41 of the driving shaft 15 and supplied to the respective sliding portions of the scroll compression mechanism 11 and the compression chamber 35. The excessive lubrication oil at the respective sliding portions of the scroll compression mechanism 11 and the compression chamber 35 is collected from the return oil path 47 to the oil collector 46, passed through the notches 54 provided on the outer periphery of the stator 37, and then returned to the lower side of the driving motor 13.

Next, the construction of the upper balancer 63, the lower balancer 77 and the auxiliary balancer 64 will be described.

The rotor 39 is provided with rivet holes 66 penetrating vertically through the rotor 39. The lower balancer 77 and the auxiliary balancer 64 are swaged to the rotor 39 by using rivets which are inserted into the rivet holes 66. The auxiliary balancer 64 is secured only just below the upper balancer 63. The auxiliary balancer 64 formed of non-magnetic material is secured by using the gap between the upper balancer 63 and the rotor 39, and serves to assist the upper balancer 63. Accordingly, the auxiliary balancer 64 opposes the centrifugal force caused by the circular motion of the swing scroll 25 together with the upper balancer 63, and the lower balancer 77 directs in the opposite direction to the upper balancer 63 and the auxiliary balancer 64.

The driving shaft 15 rotates while keeping the dynamic balance with the swing scroll 25, the eccentric shaft portion 15A, etc. by the upper balancer 63, the lower balancer 77 and the auxiliary balancer 64. The driving shaft 15 rotates while keeping the weight balance by the upper balancer 63, the lower balancer 77 and the auxiliary balancer 64, whereby the swing scroll 25 makes an orbital motion with respect to the fixed scroll 23. In connection of the orbital motion of the swing scroll 25, the compression chamber 35 is configured to compress the refrigerant sucked therein through the suction pipe 31 due to the contraction of the volume between both the laps 23B and 25B toward the center. Furthermore, the lower surface of the lower balancer 77 is provided with a regulation plate 55 which is swaged to the rotor 39 integrally with the lower balancer 77 by using the rivets 65. The regulation plate 55 is used to regulate the rotation of the rotor 39 when the windings of the rotor 39 are magnetized.

FIG. 2 is a diagram showing the rotor 39 when the rotor 39 is viewed from the lower side. As shown in FIG. 2, the four rivet holes 65 are provided away from the shaft center of the driving shaft 15 at the same distance so as to be spaced from one another at substantially the same interval in the peripheral direction of the rotor 39. The lower balancer 77 has a shaft hole 77 in which the driving shaft 15 is inserted, and four fixing holes 77B in which the rivets 65 are inserted. The lower balancer 77 has a large-diameter portion 77C which has the fixing holes 77B formed at two places and is designed in a substantially sectorial shape while the center thereof is located at the shaft center of the driving shaft 15, and a small-diameter portion 77D which has the remaining two fixing holes 77B and is designed to be smaller in diameter than the large-diameter portion 77C while the center thereof is located at the shaft center of the driving shaft 15. The lower balancer 77 is formed of one piece of non-magnetic material such as brass or the like. The lower balancer 77 is secured to the rotor 39 so that the large-diameter portion 77C and the small-diameter portion 77D are arranged in association with the upper balancer 63 so as to make the centrifugal force acting during rotation of the driving shaft 15 direct in the opposite direction to the upper balancer 63. According to this construction, the lower balancer 77 which is asymmetrically formed in association with the upper balancer 63 can be formed of one piece of non-magnetic material. Accordingly, as compared with a case where the lower balancer is constructed by combining two balancers having different weights, the fixing work of the lower balancer 77 can be simplified more greatly.

Figure 3:
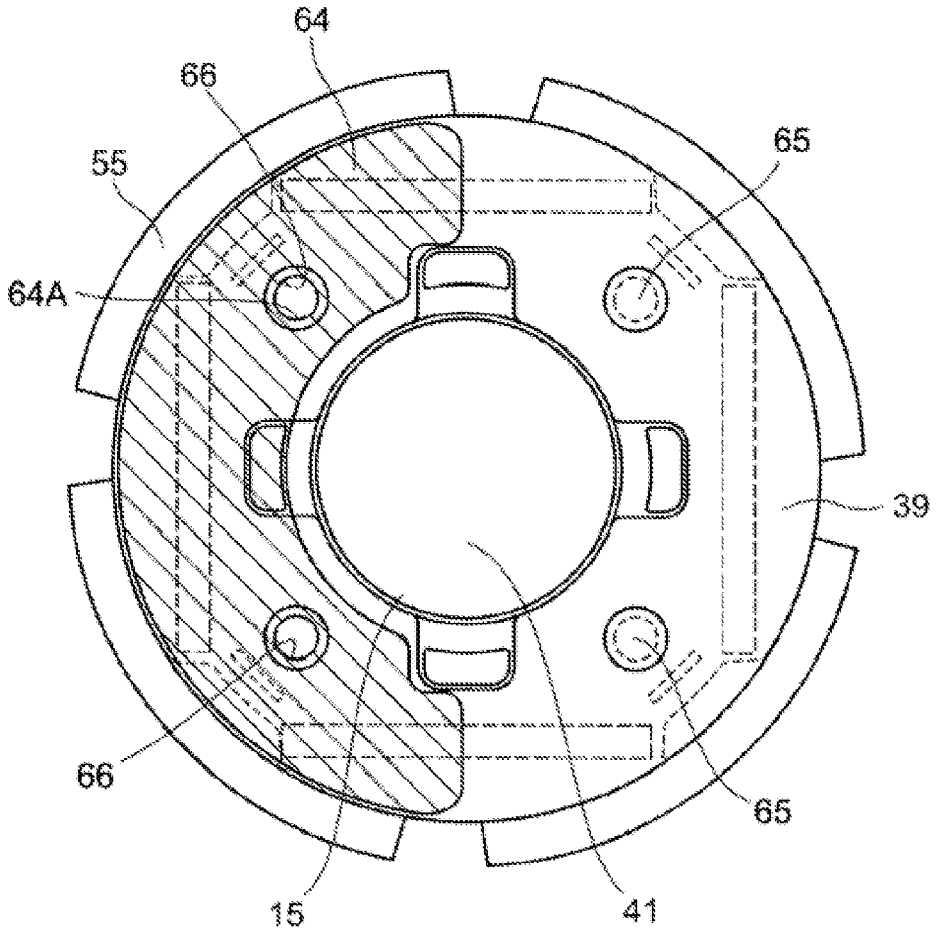
FIG. 3 is a diagram showing an aspect of an auxiliary balancer.

FIG. 3 is a top view of the rotor 39 of the scroll compression device 1 which is cross-sectioned at the position of the auxiliary balancer 64. The auxiliary balancer 64 is formed of non-magnetic material such as brass or the like, and configured in a semi-circular shape while the center thereof is located at the shaft center of the driving shaft 15. The inner peripheral side of the auxiliary balancer 64 is cut out in the peripheral direction so as to avoid the driving shaft 15. The auxiliary balancer 64 is provided with the fixing holes 64A which are formed at two places and in which the rivets 65 are inserted. The rivets 65 penetrating through the small-diameter portion 77D of the lower balancer 77 are inserted in the fixing holes 64A of the auxiliary balancer 64. Accordingly, the auxiliary balancer 64 is provided positionally symmetrically with the large-diameter portion 77C of the lower balancer 77, and serves to assist the upper balancer 63.

According to this construction, the auxiliary balancer 64 formed of non-magnetic material is secured by using the gap between the upper balancer 63 and the rotor 39. Therefore, the leakage magnetic flux of the rotor 39 can be prevented, and the driving shaft 15 can be rotated with establishing the dynamic balance with the swing scroll 25, the eccentric shaft portion 15A, etc. by using the auxiliary balancer 64 formed of material having large specific gravity such as brass or the like even when the elimination capacity of the scroll compression device 1 is increased.

Furthermore, the auxiliary balancer 64 and the lower balancer 77 are secured to the rotor 39 by the rivets inserted in the rivet holes 66 of the rotor 39, and can be secured to the scroll compression device 1 while fixed integrally with the rotor 39.

As described above, according to the embodiment to which the present invention is applied, the scroll compression mechanism 11 for compressing refrigerant and the driving motor 13 which is connected to the scroll compression mechanism 11 through the driving shaft 15 to drive the scroll compression mechanism 11 are accommodated in the casing 3, the scroll compression mechanism 11 is supported in the casing 3 by the main frame 21, the stator 37 of the driving motor 13 is directly or indirectly supported in the casing 3, the driving shaft 15 is connected to the rotor 39 of the driving motor 13, the driving shaft 15 is supported in the casing 3 by the bearing plate 8, the upper balancer 63 formed of magnetic material is secured onto the shaft at a higher position than the stator 37 of the driving shaft 15, the lower balancer 77 formed of non-magnetic material is secured to the lower end of the rotor 39, and the auxiliary balancer 64 formed of non-magnetic material is secured in the gap between the upper end of the rotor 39 and the upper balancer 63. Accordingly, the gap for preventing the leakage magnetic flux of the rotor 39 is provided between the upper balancer 63 and the rotor 39, and the auxiliary balancer 64 formed of non-magnetic material can be secured by using this gap. Therefore, the auxiliary balancer 64 can serve as an assist for the upper balancer 63, and even when the elimination capacity is increased, the driving shaft 15 can be rotated with keeping the balance with the swing scroll which makes an eccentric circular motion. Accordingly, even when an upper balancer 63 formed of magnetic material such as inexpensive iron or the like is used, the leakage magnetic flux of the rotor 39 can be prevented, and the scroll compression device which is adaptable to a larger elimination capacity can be provided.

Furthermore, according to the embodiment to which the present invention is applied, the lower balancer 77 and the auxiliary balancer 64 are swaged to the rotor 39 by using the rivets 65. Therefore, the lower balancer 77 and the auxiliary balancer 64 can be secured to the rotor 39 by using the rivets 65, and integrally fixed to the driving shaft 13. Accordingly, the lower balancer 77 and the auxiliary balancer 64 can be secured to the scroll compression device 1 integrally with the driving motor 13, thereby enhancing the workability of fixing the balancer for making the driving shaft 15 rotate with keeping the balance with the swing scroll which makes an eccentric circular motion.

Still furthermore, according to the embodiment to which the present invention is applied, the auxiliary balancer 64 is secured just below the upper balancer 63. Therefore, the auxiliary balancer 64 formed of non-magnetic material is secured in the gap between the upper balancer 63 formed of inexpensive iron or the like and the rotor 39, whereby the magnetic flux of the rotor 39 can be prevented from leaking. Furthermore, the auxiliary balancer 64 is configured to be fixed to the rotor 39 by the rivets inserted in the rivet holes 66 which are formed in the rotor 39 and located at two places just below the upper balancer 63. Accordingly, as compared with a case where the auxiliary balancer 64 is fixed by using all the rivets 65 inserted in the rivet holes 66 formed at four places of the rotor 30, the material of the auxiliary balancer 64 can be reduced, and the cost of manufacturing the auxiliary balancer 64 can be reduced.

Still furthermore, according to the embodiment of the present invention, the stator 37 of the driving motor 13 is supported in the casing 3 by the spacer ring 38. Therefore, scroll compression devices 1 in which driving motors 13 different in output power are respectively mounted can be formed by merely changing the thickness of the spacer ring 38 without changing the size of the casing 3. Accordingly, in a case where the elimination capacity is increased, the thickness of the spacer ring 13 can be reduced or a driving motor 13 having a large volume can be secured while the spacer ring 13 is removed even when it is necessary to mount a driving motor 13 having a large output, and the parts of the scroll compression devices 1 can be made common.

Still furthermore, according to the embodiment to which the present invention is applied, the driving motor 13 is a DC driving motor which is operated by a PWM inverter so that the rotational torque thereof is controlled. Therefore, the driving motor 13 can be miniaturized by using a DC motor having a high output efficiency, and further occurrence of needless heat caused by increase/decrease of the voltage of the driving motor 13 can be prevented by operating the driving motor with the inverter, thereby enhancing the driving efficiency.

DESCRIPTION OF REFERENCE

1 scroll compression device
3 casing
8 bearing plate
11 scroll compression mechanism
13 driving motor (DC driving motor)
15 driving shaft
37 stator
39 rotor
63 upper balancer
64 auxiliary balancer
65 rivet
77 lower balancer

The invention claimed is:

1. A scroll compression device, characterized in that a scroll compression mechanism for compressing refrigerant and a driving motor that is connected to the scroll compression mechanism through a driving shaft and drives the scroll compression mechanism are accommodated in a casing, the scroll compression mechanism is supported in the casing by a main frame, a stator of the driving motor is directly or indirectly supported in the casing, the driving shaft is connected to a rotor of the driving motor and the driving shaft is supported in the casing by a bearing plate, an upper balancer formed of magnetic material is secured onto the shaft above the stator of the driving shaft, a lower balancer formed of non-magnetic material is secured to a lower end of the rotor by swaging to the rotor with rivets that penetrate vertically through the rotor, and an auxiliary balancer formed of non-magnetic material is secured in a gap between an upper end of the rotor and the upper balancer with at least some of the rivets, the auxiliary balancer is configured in a semi-circular shape while the center thereof is located at the shaft center of the driving shaft, and the inner peripheral side is cut out in the peripheral direction so as to avoid the driving shaft, the lower balancer has a shaft hole in which the driving shaft is inserted, and plural fixing holes in which the rivets are respectively inserted to each hole, and the lower balancer has a large-diameter portion that is provided positionally symmetrically with the auxiliary balancer, and at least two small-diameter portions that have at least some of the fixing holes, and the auxiliary balancer is secured to the rotor with said at least some of the rivets which penetrate through said at least some of the fixing holes disposed in each of the small-diameter portions.

2. The scroll compression device according to claim 1, wherein the auxiliary balancer is secured only just below the upper balancer.

3. The scroll compression device according to claim 1, wherein the stator of the driving motor is supported through a spacer ring in the casing.

4. The scroll compression device according to claim 1, wherein the driving motor is a DC driving motor which is driven by an inverter.

5. The scroll compression device according to claim 2, wherein the stator of the driving motor is supported through a spacer ring in the casing.

6. The scroll compression device according to claim 2, wherein the driving motor is a DC driving motor which is driven by an inverter.

7. The scroll compression device according to claim 3, wherein the driving motor is a DC driving motor which is driven by an inverter.

* * * * *